US006168755B1

(12) United States Patent
Biancaniello et al.

(10) Patent No.: US 6,168,755 B1
(45) Date of Patent: Jan. 2, 2001

(54) HIGH NITROGEN STAINLESS STEEL

(75) Inventors: Francis S. Biancaniello; Stephen D. Ridder, both of Gaithersburg; Rodney D. Jiggetts, Germantown, all of MD (US)

(73) Assignee: The United States of America as represented by the Secretary of Commerce, Washington, DC (US)

( * ) Notice: Under 35 U.S.C. 154(b), the term of this patent shall be extended for 0 days.

(21) Appl. No.: 09/321,113

(22) Filed: May 27, 1999

Related U.S. Application Data

(60) Provisional application No. 60/086,761, filed on May 27, 1998.

(51) Int. Cl.[7] ..... C22C 38/38; C22C 38/58; C22C 29/14; B22F 3/12

(52) U.S. Cl. ..... 420/57; 420/59; 75/244; 75/246; 419/13; 419/49; 419/46

(58) Field of Search ..... 420/57, 59; 75/244, 75/246; 419/13, 49, 46

(56) References Cited

U.S. PATENT DOCUMENTS

| | | | | |
|---|---|---|---|---|
| 4,340,432 | * | 7/1982 | Hede | 148/11.5 |
| 4,599,214 | * | 7/1986 | Luton | 419/4 |
| 4,765,953 | | 8/1988 | Hagenfeldt et al. . | |
| 4,853,185 | | 8/1989 | Rothman et al. . | |
| 4,888,153 | * | 12/1989 | Yabuki et al. | 420/57 |
| 4,929,419 | * | 5/1990 | Wegman et al. | 420/56 |
| 5,019,332 | * | 5/1991 | Wegman et al. | 420/59 |
| 5,114,470 | | 5/1992 | Biancaniello et al. . | |
| 5,141,705 | | 8/1992 | Stenvall et al. . | |
| 5,242,758 | * | 9/1993 | Hitchcock et al. | 428/547 |
| 5,480,609 | | 1/1996 | Dupoiron et al. . | |
| 5,494,636 | | 2/1996 | Dupoiron et al. | 420/586.1 |
| 5,841,046 | | 11/1998 | Rhodes et al. . | |
| 5,856,625 | * | 1/1999 | Saunders et al. | 75/236 |

OTHER PUBLICATIONS

G. O. Rhodes and J. J. Conway, J. Met. 48, 4 (1996), pp.28–31.

F. S. Biancaniello et al., in *Advanced Particulate Materials & Processes* 1997, MPIF (1997), pp 309–316.

(List continued on next page.)

*Primary Examiner*—Daniel J. Jenkins
*Assistant Examiner*—Nicole Coy
(74) *Attorney, Agent, or Firm*—Wenderoth Lind & Ponack LLP

(57) ABSTRACT

Disclosed is a high nitrogen stainless steel alloy and alloy powder comprising chromium (Cr), molybdenum (Mo), manganese (Mn), nickel (Ni), nitrogen (N) and iron (Fe). The composition of the stainless steel alloy and powder comprises between about 27 and about 30% by weight Cr, between about 1.5 and about 4.0% by weight Mo, Mn present and is present in an amount up to 15% by weight, at least about 8% by weight Ni, and about 0.8 to about 0.97% by weight N with the balance being iron. It has been discovered that forming an alloy of this chemistry using nitrogen gas atomization process, followed by a consolidation process, the alloy is less likely to form detrimental ferrite, stable nitride and sigma (σ) phases, without the need for further processing, such as solution treating and quenching. This allows for the formation of stainless steel articles having a thicker cross-section with reduced processing cost.

24 Claims, 6 Drawing Sheets

OTHER PUBLICATIONS

Rechsteiner et al., "New Methods for the Production of High Nitrogen Stainless Steels", *Innovation Stainless Steel*, Florence, Italy, Oct. 1993, pp. 2107–2212.

K. Orita et al., "Developments and Production of 18 Mn–18 Cr Nonmagnetic Retaining Ring with High Yield Strength", *ISIJ Int.*, vol. 30, No. 8, 1990, pp. 587–593.

Janowski et al, "Beneficial Effects of Nitrogen Atomization on an Austenitic Stainless Steel", *Metall. Trans. A*, vol. 23A, 1992, pp. 3263–3272.

Eckenrod et al., "P/M High Performance Stainless Steels for Near Net Shapes," Processing, Properties and Application Advances in Powder Metallurgy and Particulate Material, 1993. vol. 4, pp. 131–140.

G. O. Rhodes et al, in Advanced Particulate Materials & Processes 1997, MPIF (1997), pp. 295–308.

G. O. Rhodes et al., "High Nitrogen Corrosion Resistant Austenitic Stainless Steels by Hot Isostatic Compaction of Gas Atomized Powder." Corrosion/96, paper 416, (Houston TX; NACE International, 1996).

Rechsteiner et al., "New Methods for the Production of High Nitrogen Stainless Steels", Innovation Stainless Steel, Florence, Italy, Oct. 1993, pp. 2107–2212.

K. Orita et al., "Development and Production of 18Mn—18 Cr Non–Magnetic Retaining Ring with High Yield Strength", ISIJ International, vol. 30, No. 8, 1990, pp. 587–593.

Eckenrod et al., "P/M High Performance Stainless Steels for Near Net Shapes", Processing, Properties and Applications Advances in Powder Metuallurgy & Particulate Materials, 1993, vol. 4, pp. 131–140.

Biancaniello et al., "Production and Properties of nitrogenated stainless steel by gas atomization", Powder Metallurgy, 1994, pp. 2117–2120.

Biancaniello et al., "Characterization of Atomized High Nitrogen Stainless Steel", 5$^{th}$ International Conference on High Nitrogen Steels, Espoo–Finland & Stockholm–Sweden, May 1998.

Biancaniello et al., "Powder Metallurgy High Nitrogen Stainless Steel", 5$^{th}$ International Conference on High Nitrogen Steels, Espoo–Finland & Stockholm–Sweden, May 1998.

Janowski et al., "The Effect of Backfill and Atomizing Gas on the Powder Porosity and Mechanical Properties of 304L Stainless Steel", P/M in Aerospace, Defense and Demanding Applications—1993, pp. 363–370.

Streinz et al., "Dramatically Improved Corrosion Behavior of 304L Stainless Steel Through Nitrogen Atomization", P/M in Aeorspace, Defense and Demanding Applications, pp. 123–130.

* cited by examiner

HIGH NITROGEN STAINLESS STEEL

This application claims the benefit of U.S. Provisional Application Ser. No. 60/086,761, filed May 27, 1998.

BACKGROUND OF THE INVENTION

1. Field of the Invention

The invention relates to a high nitrogen stainless steel alloy powder, a high nitrogen content stainless steel alloy, a process for producing the high nitrogen stainless steel alloy powder and alloy, and articles prepared from the same.

2. Description of the Related Art

Early research on nitrogen-containing iron alloys was first reported at the Carnegie Institute in 1912. Later in the 1920's and 1930's, additional research was conducted in Europe, primarily in Germany, and to a lesser degree in the United States. Later in the 1970's, Armco developed a series of nitrogen containing steel alloys (the Nitronic® alloys), with specific alloys designed for either high strength, wear resistance or improved corrosion properties (Development of the Stainless Steels, Armco Inc., Middletown, Ohio (1983)). In the last 10 to 15 years there has been a dramatic increase in high nitrogen steel (HNS) research as evidenced by five international conferences on HNS, the latest being conducted in Helsinki and Stockholm. Despite the outstanding properties that a growing number of researchers have attributed to HNS, several factors have limited the huge potential of these alloys. These factors include: a) the formation of brittle, stable nitrides and intermetallics which precipitate during the slow cooling encountered during ingot casting, b) other casting defects such as macrosegregation which render these highly alloyed materials unworkable by conventional wrought processing techniques, and c) the difficulty in producing predictable nitrogen levels during both conventional and pressurized casting methods.

Prior research, particularly that which is described in G. O. Rhodes and J. J. Conway, J. Met. 48, 4 (1996), pp.28–31, and F. S. Biancaniello et al., in *Advanced Particulate Materials & Processes* 1997, MPIF (1997), pp 309–316, each incorporated herein by reference, has shown that many of the problems can be overcome by melting high nitrogen stainless steel (HNSS) under a nitrogen atmosphere, atomizing with $N_2$ gas and consolidating with a Hot Isostatic Press (HIP). The beneficial effects of nitrogen on the properties of HNSS include improved yield strength (YS), ultimate tensile strength (UTS), Charpy V-notch Impact Energy (CVN), corrosion and wear properties; all these properties improve with increasing nitrogen content. Nitrogen promotes the stability of the austenite phase (no martensite formation during cold work), and improves resistance to all types of corrosion. The benefits of nitrogen additions are reinforced by the microstructural refinements, enhanced chemical homogeneity and increased solubility of constituents which all convey from powder metallurgy rapid solidification process (RSP). RSP and HIP also provide the opportunity for near-net-shape fabrication of the alloys, minimizing machining time and scrap.

Typically a solution treatment and quenching are required to remove stable nitrides and sigma ($\sigma$) phases, as is reported in several articles including A. Rechsteiner et al., "New Methods for the Production of High Nitrogen Stainless Steels", *Innovation Stainless Steel*, Florence, Italy, October 1993, pp. 2107–2212; K. Orita et al., "Developments and Production of 18 Mn-18 Cr Nonmagnetic Retaining Ring with High Yield Strength", ISIJ Int., Vol. 30, No. 8, 1990, pp. 587–593; G. 0. Rhodes and J. J. Conway, J. Met. 48, 4 (1996), pp. 28–31; and F. S. Biancaniello et al., *Advanced Particulate Materials & Processes* 1997, MPIF (1997), pp 309–316. Also, see U.S. Pat. No. 5,841,046.

A few U.S. Patents have been issued related to nitrogen containing stainless steels.

U.S. Pat. No. 5,480,609 to Dupoiron et al., incorporated herein by reference, is directed to a steel containing 20 to 30% Cr, 25–32% Ni, 3–7% Mo, 0.05 to 5.4% Mn and 0.35–0.8% N, wherein the percentages are based on weight. As is typical for high nitrogen content steels, this patent discloses that the steel has corrosion resistance and structural stability. This patent further indicates that the nitrogen content should be limited to 0.8 to "avoid deteriorating the impact strength excessively by precipitating nitrides".

U.S. Pat. No. 5,841,046 to Rhodes et al., incorporated herein by reference, is directed to a stainless steel containing 20–29% Cr, 17–35% Ni, 3–10% Mo, 0.5 to 12% Mn and at least 0.7, preferably 0.8–1.1% N, wherein all of the percentages are based on weight. This patent further indicates a solution annealing process and water quenching process are needed to avoid formation of stable chromium nitride and sigma phase precipitates.

Other U.S. Patents such as U.S. Pat. No. 4,765,953 to Hagenfeldt et al, U.S. Pat. No. 4,853,185 to Rothman et al, and U.S. Pat. No. 5,141,705 to Stenvall et al., all teach nitrogen containing stainless steels. However, the compositions of these patents are outside the composition of the present invention.

In the state of the present art, the phrase "high nitrogen stainless steel" has an accepted meaning of a stainless steel having a nitrogen content of at least 0.3% by weight and more specifically at least about 0.5% by weight.

SUMMARY OF THE INVENTION

The present invention relates to a high nitrogen stainless steel alloy and alloy powder comprising chromium (Cr), molybdenum (Mo), manganese (Mn), nickel (Ni), nitrogen (N) and iron (Fe). The composition of the stainless steel alloy and alloy powder comprises about 27 to about 30% by weight Cr, about 1.5 to about 4.0% by weight Mo, Mn is present in the composition and is present in an amount up to 15% by weight, at least about 8% by weight Ni, and about 0.8 to about 0.97% by weight N with the balance being iron.

The present invention also relates to the formation of a stainless steel alloy which contains substantially a gamma ($\gamma$) microstructure. In addition, the high nitrogen stainless steel of the present invention has excellent physical properties in that the stainless steel is very strong, hard, ductile, and corrosion resistant. In addition, the stainless steel of the present invention has a high work hardening coefficient.

In the third aspect of the invention, the invention relates to a process for preparing the foregoing stainless steel alloy composition using a nitrogen gas atomization and consolidation process including, but not limited to, a hot isostatic pressing, hot extrusion or hot pressing .

In a final aspect of the present invention, the invention relates to an article prepared from stainless steel alloy. In particular, the stainless steel alloy of the present invention can be used to produce biomedical implants, especially orthopedic implants.

DETAILED DESCRIPTION OF THE INVENTION

Figure 1A:
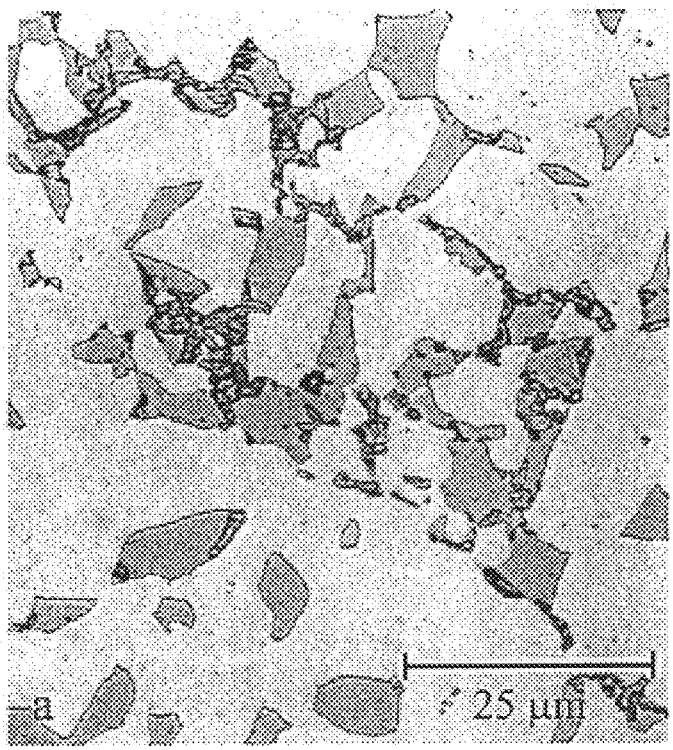
FIG. 1 shows the microstructure of a prior art stainless steel alloy.

The inventors of the present invention have discovered that a stainless steel alloy having the composition stated above can be formed using a nitrogen gas atomization process followed by consolidation. This particular stainless steel alloy is less likely to form detrimental stable nitrides, such as $Cr_2N$, and sigma (σ) phases. In fact, the alloys prepared in accordance with this invention contained no stable nitride or sigma (σ) phases.

In addition, it has been discovered that the high nitrogen stainless steel of the present invention is very strong, hard, ductile and corrosion resistant. As with all high nitrogen stainless steels, the stainless steel alloy of the present invention has a high work hardening coefficient. The hardness of the alloy of the present invention can be increased by cold work.

As is discussed above, prior art methods are able to produce stainless steel alloys without stable nitride and sigma phases using gas atomization and consolidation via a hot isostatic press, however, the prior art methods require additional processing of the stainless steel alloy after consolidation to eliminated the stable nitride and sigma (σ) phases. The additional processing of the stainless steel alloy after consolidation with a hot isostatic press involves solution treating and water quenching of the stainless steel alloy. Using the process of the present invention to form a stainless steel alloy having the foregoing described composition, an alloy can be prepared without the need to eliminate stable nitride and sigma (σ) phases by further processing the alloy after consolidation. This results in a drastic reduction in the processing costs and the ability to form thicker sections of stainless steel alloy.

In the methods of the prior art, the cross-sectional thickness of a section of the stainless steel alloy is limited by the quench sensitivity of the alloys. That is, if the alloy has a cross-section thickness such that the ability to rapidly cool the interior portions of the specimen is limited, the quenching step of the further processing can not rapidly cool the entire portion of the alloy. This results in the reformation of the stable nitride and sigma (σ) phases in the alloy. Therefore, the cross-sectional thickness of the alloys formed by the prior art is limited by the ability to quench the entire thickness of the alloy.

In the inventive stainless steel alloy of the present invention, formation of the stable nitride and sigma (σ) phases is less likely to occur. This allows the fabrication of thicker alloy cross-sections because the alloy is less quench sensitive. Generally, there is less likelihood that the alloy has to be solution treated and quenched to remove any nitride and sigma (σ) phases from the microstructure. Of course, the alloys of the present invention may optionally be solution treated and quenched.

In the prior art methods, solution treatment and quenching is effected to eliminate the nitride and sigma (σ) phases, however, a duplex matrix is still another source of concern. In a duplex matrix, a ferrite phase is formed in addition to the austenite phase. A ferrite phase can cleave and fail catastrophically. A ferrite phase also reduces the corrosion resistance in the ferrite crystal structure having much lower nitrogen solubility than the FCC γ-phase.

Forming a stainless steel alloy with a composition of the present invention avoids these problems in the prior art. A goal set forth by the present inventors of the present invention was to form an alloy having substantially a gamma (γ) microstructure. The alloys of the present invention have a gamma (γ) microstructure in an amount of at least 99% by volume.

The high nitrogen stainless steel alloy produced in accordance with present invention has high hardness, high strength, high ductility and high corrosion resistance. Typically, the alloys of the present invention have a hardness greater than about 275 ($HV_{1000}$), a yield strength greater than 590 MPa, an ultimate tensile strength of at least 1000 MPa, a notch impact strength of at least about 100 J, and an elongation of at least 50%.

In the present invention, controlling the amounts of each of the metal constituents of the stainless steel alloy is important. It has been discovered that by controlling the amount of each of the metal components and nitrogen within the following parameters, an alloy can be formed which has substantially a gamma (γ) microstructure, which is less likely to have stable nitride and sigma phases and has excellent physical properties, including high hardness, high strength, high ductility and corrosion resistance, and phase stability.

Chromium (Cr) content has been set in the range of about 27% to about 30% by weight of the alloy. Preferably, the Cr mass fraction should be between 27.4% and 29.9% by weight. The presence of Cr in this amount ensures that the resulting alloy will have a relatively high nitrogen content. The more Cr present in the alloy, the higher the nitrogen solubility.

Molybdenum (Mo) content has been set at about 1.5 to about 4.0% by weight of the composition. Preferably, the Mo content should be between 1.5 and 3.0% by weight and more preferably between 1.7% and 2.3% by weight and most preferably at or about 2.0% by weight, for example, 1.9 to 2.05% by weight. This amount of Mo helps improve the corrosion properties. Greater amounts of Mo should not be used since Mo is relatively expensive and Mo tends to form an intermetallic sigma (σ) phase.

Manganese (Mn) is present in the stainless steel alloy and should be limited to about 15%, i.e., less than or equal to 15% by weight. Mn increases the solubility of nitrogen in the alloy, however, Mn has a detrimental effect on the corrosion properties of the resulting alloy. Preferably, the mass fraction of Mn should not exceed 10% by weight. However, this parameter can be relaxed so that the resulting alloy will have the minimum nitrogen content of 0.8%. Most preferably, the alloy of the present invention should contain between about 6.0% and about 15% by weight Mn.

Nickel (Ni) should be present in an amount of at least about 8% by weight. Generally, the Ni content should not exceed about 22% by weight, however this is not an absolute upper limit. Although higher amounts of Ni can be used in the stainless steel alloy of the present invention, it is preferable that the Ni content should be between about 10% and 16% by weight and most preferably between 12% and 16% by weight. Although Ni is high in cost and detrimental to nitrogen solubility, Ni helps to insure gamma (γ) phase stability.

Nitrogen (N) should be present in an amount between about 0.8% and about 0.97% by weight, and preferably between 0.8% and 0.95% by weight. This content of N ensures high strength and gamma (γ) stability. The amount of N should not exceed the upper limit of about 0.97% by weight since amounts of N exceeding this upper limit tend to from stable nitrides, such as $Cr_2N$.

The alloy of the present invention can also contain up to about 3% by weight Tungsten (W). As is known in the art, W tends to reduce the formation of intermetallic phases.

The balance of the high nitrogen stainless steel alloy is iron (Fe). Typically, the amount of Fe present in the alloy will not exceed about 60% by weight. Preferably, the content of Fe is between about 39% and about 50% by weight, and most preferably between 39% and 47% by weight.

Finally, the alloy of the present invention may also contain a minor amount of impurities. Typical impurities include, but are not limited to, silicon, oxygen, carbon and sulfur. Generally, the amount of the impurities should not exceed about 1% by weight of the alloy, and more preferably not exceed about 0.6% by weight of the alloy.

The gas atomization process used in the present invention is known to those skilled in the art. U.S. Pat. No. 5,114,470, which is incorporated herein by reference, describes, the gas atomization process. Other references such as Janowski et al, "Beneficial Effects of Nitrogen Atomization on an Austenitic Stainless Steel", *Metall. Trans. A*, Vol. 23A, 1992, pp. 3263–3272, hereby incorporated by reference, also describe the gas atomization process. Briefly, a controlled atmosphere or vacuum induction melting can be used to produce the stainless steel alloy powder of the present invention. The starting mixture of metals is melted by a known method and then the melt is subjected to gas atomization using nitrogen gas. The product of these process steps is an alloy powder. Preferably, the mixture of metals is melted in the presence of a nitrogen atmosphere or under a vacuum.

After the alloy powders are formed, the powders can be consolidated using methods known to those skilled in the art. Consolidation methods include, but are not limited to, hot isostatic pressing (HIP), hot pressing, metal injection molding or hot metal extrusion. It is preferred that a hot isostatic press is used to consolidate the metal powder.

Like the gas atomization process, hot isostatic pressing is well known to those skilled in the art and are described in, e.g., Eckenrod et al, "P/M High Performance Stainless Steels for Near Net Shapes," Processing, Properties and Application Advances in Powder Metallurgy and Particulate Material,1993, Vol. 4, pp.131–140.

EXAMPLES

Table 1 shows the nominal starting compositions for each of the alloys formed in accordance with this invention. A NIST supersonic inert gas metal atomizer (SIGMA) is used to produce the alloys of the examples. The mixture of metals for each was melted using vacuum induction melting at a temperature at or above the melting temperature and under a nitrogen atmosphere. The melting chamber is then backfilled with nitrogen. The liquid metal is then subjected to nitrogen gas atomization in a NIST supersonic inert gas metal atomizer (SIGMA), which is an example of a discrete jet, close-coupled gas atomizer. This process results in an alloy powder.

Each alloy powder was subjected to a consolidation using a hot isostatic press at a temperature of 1180° C. and a pressure of 29 ksi for a period of two hours.

Table 2 shows several compositions of high nitrogen stainless steel alloys prepared within the parameters of the present invention. The only exception is NSS.057 which was prepared for comparative purposes.

Table 3 shows the physical properties for the alloys formed.

TABLE 1

| Approximate Nominal Starting Compositions (mass fraction %) | | | | | | | | | |
|---|---|---|---|---|---|---|---|---|---|
| Alloy | Fe | Cr | Ni | Mn | Mo | Si | O | C | S |
| NSS.082 | 41 | 30 | 14 | 12 | 2 | 0.5 | 0.059 | 0.017 | 0.002 |
| NSS.083 | 43 | 30 | 14 | 10 | 2 | 0.5 | 0.055 | 0.021 | 0.003 |
| NSS.084 | 39 | 27 | 15 | 15 | 2 | 0.5 | 0.045 | 0.019 | 0.003 |
| NSS.085 | 44 | 30 | 15 | 8 | 2 | 0.5 | 0.046 | 0.014 | 0.003 |
| NSS.086 | 46 | 29 | 15 | 6 | 2 | 0.5 | 0.044 | 0.016 | 0.003 |
| NSS.087 | 45 | 29 | 13 | 9 | 2 | 0.5 | 0.042 | 0.020 | 0.004 |

TABLE 2

| Alloy Compositions (mass fraction %) | | | | | | | | | | |
|---|---|---|---|---|---|---|---|---|---|---|
| Alloy | Fe | Cr | Ni | Mn | Mo | N | SI | O | C | S |
| NSS.057 | 62.59 | 24.97 | 4.84 | 4.06 | 3.00 | 0.50 | 0.00 | 0.019 | 0.016 | <.003 |
| NSS.082 | 40.79 | 29.82 | 13.93 | 11.99 | 1.94 | 0.97 | 0.48 | 0.059 | 0.017 | 0.002 |
| NSS.083 | 42.56 | 29.90 | 13.91 | 10.29 | 1.95 | 0.94 | 0.37 | 0.055 | 0.021 | 0.003 |
| NSS.084 | 39.27 | 27.42 | 14.94 | 15.07 | 1.93 | 0.84 | 0.46 | 0.045 | 0.019 | 0.003 |
| NSS.085 | 43.81 | 29.65 | 15.13 | 8.03 | 1.96 | 0.86 | 0.50 | 0.046 | 0.014 | 0.003 |
| NSS.086 | 46.33 | 29.35 | 15.02 | 5.96 | 1.94 | 0.83 | 0.51 | 0.044 | 0.016 | 0.003 |
| NSS.087 | 45.29 | 29.49 | 12.85 | 9.00 | 1.92 | 0.88 | 0.50 | 0.042 | 0.020 | 0.004 |

TABLE 3

Alloy Properties

| Alloy # | $N_R$ (%) | $N_M$ (%) | Hardness ($HV_{1000}$) | YS (MPa) | UTS (MPA) | % elong. | n | CVN (J) |
|---|---|---|---|---|---|---|---|---|
| NSS.057 | 0.51 | 0.50 | 312 | 602 | 956 | 32.30 | 0.181 | 25 |
| NSS.082 | 0.84 | 0.97 | 303 | 642 | 1096 | 55.70 | 0.214 | 69 |
| NSS.083 | 0.79 | 0.94 | 298 | 635 | 1089 | 59.35 | 0.218 | 115 |
| NSS.084 | 0.81 | 0.84 | 293 | 565 | 1034 | 57.85 | 0.231 | 126 |
| NSS.085 | 0.73 | 0.86 | 296 | 609 | 1066 | 57.80 | 0.221 | 140 |
| NSS.086 | 0.69 | 0.83 | 275 | 591 | 1066 | 53.90 | 0.225 | 132 |
| NSS.087 | 0.77 | 0.88 | 300 | 642 | 1100 | 53.10 | 0.213 | 129 |

$N_R$ = the protected nitrogen content
$N_M$ = is the measured nitrogen content
YS = yield strength
UTS = ultimate tensile strength
n = the strength hardening exponent
CVN = Charpy V-notched impact energy The properties of ultimate tensile strength, yield strength and elongation were measured in accordance with ASTM E8. ASTM E646 was followed to calculate the strain hardening exponent, and ASTM E23 was followed to calculate the impact energy. The measured uncertainty for the ultimate impact strength and yield strength is ±17 MPA, ±1.3% for elongation values, ±0.003 for the strain hardening exponent and ±4 J for the impact energy.

The volume fraction of the gamma (γ) phase for all the alloys having the composition described in Table 1 exceeds 0.99, except for NSS.057, a comparative example, which exhibited a volume fraction of gamma (γ) phase of about 0.67.

Figure 1B:
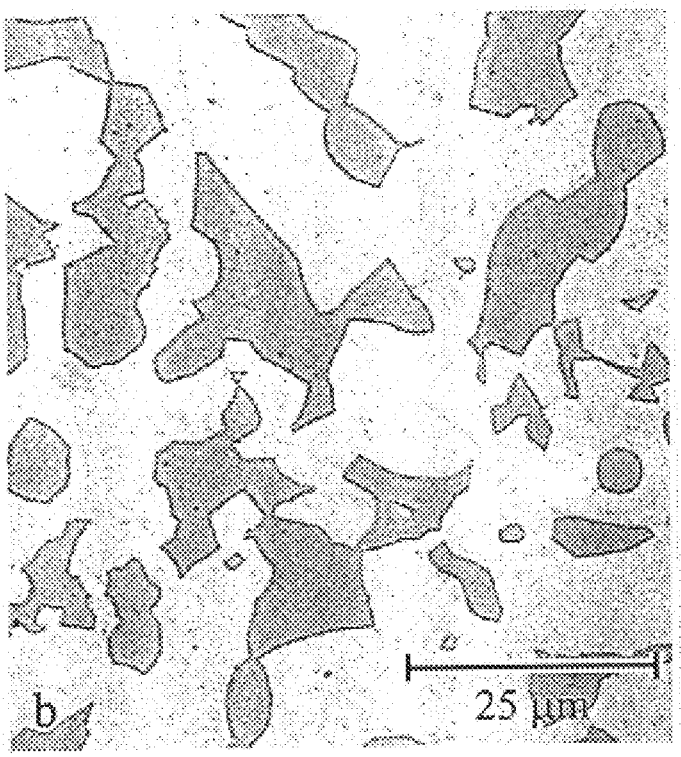

FIG. 1*a* shows the microstructure of NSS.057 which has been subject to a gas atomization and Hot Isostatic Pressing. As can be seen in this micrograph, the alloy exhibits a duplex matrix, and has $Cr_2N$ and sigma (σ) phase inclusions. FIG. 1*b* shows the same alloy which has been further solution treated and quenched. It can be seen that the $Cr_2N$ and sigma (σ) phase inclusions have been removed. However, in this alloy both the ferrite and austenite phase remain present in the alloy.

Figure 2:
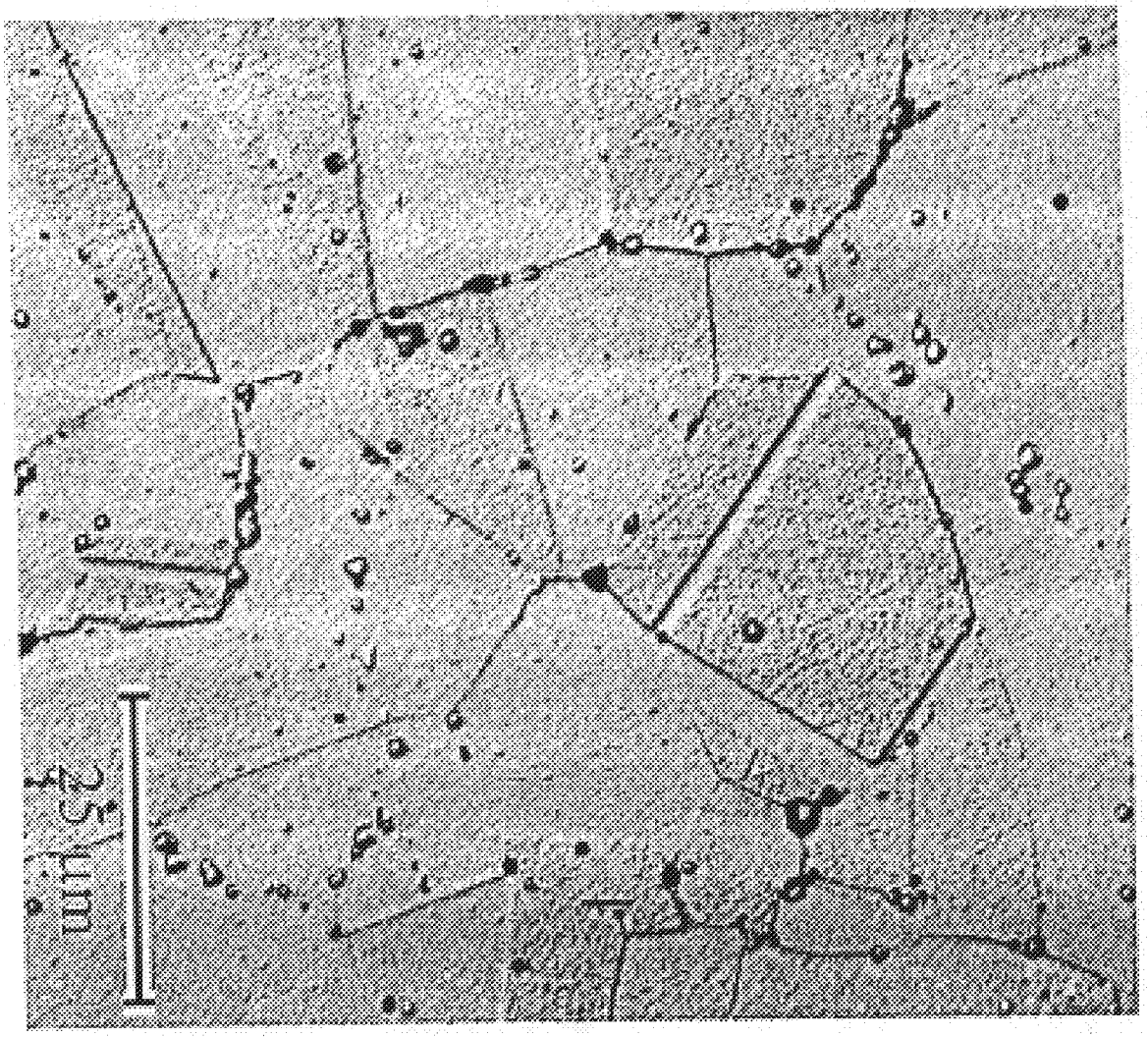
FIG. 2 shows the microstructure of a stainless steel alloy of the present invention.

In contrast, FIG. 2 shows the microstructure of consolidated high nitrogen stainless steel of the present invention. In particular, FIG. 2 is a micrograph of the structure for NSS.085. As can be seen, the structure is a fully dense equiaxed grain structure. The micrograph also shows the inclusion of small precipitates of manganese silicate amounting to less than 1% by volume of the structure. This data is typically for the alloys prepared in accordance to this invention.

Figure 3:
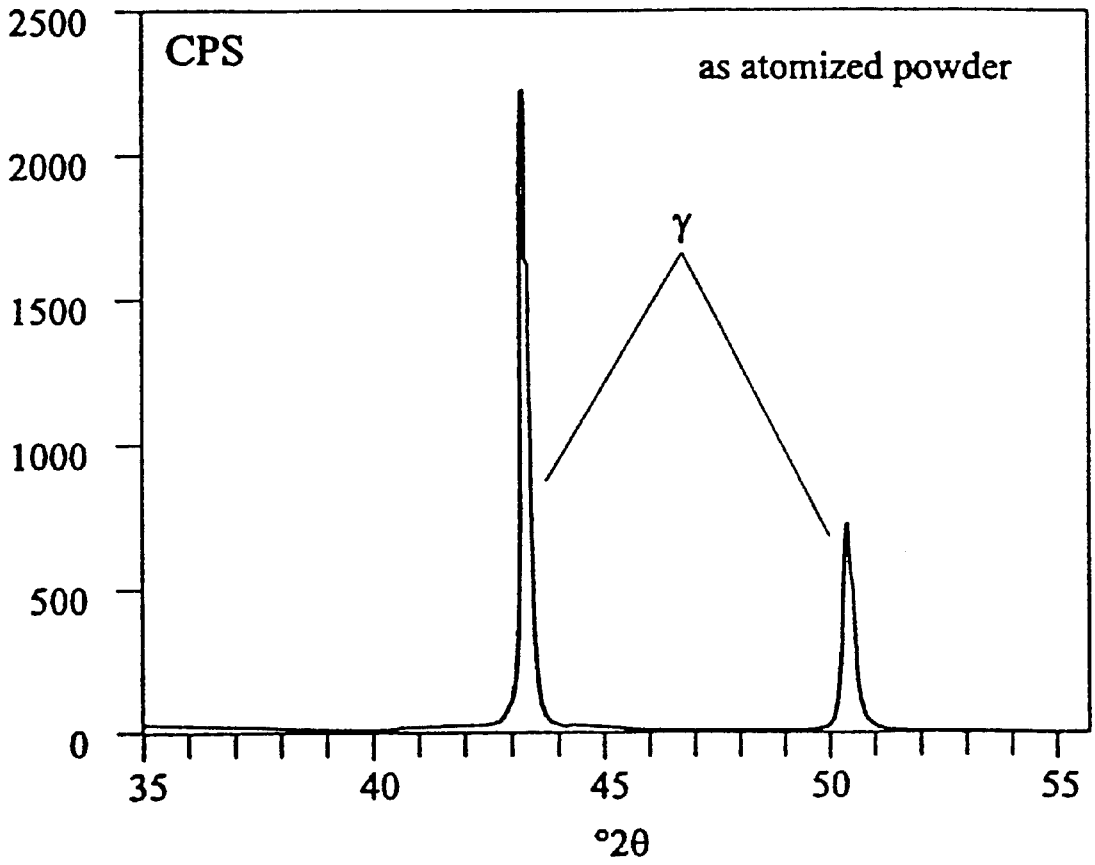
FIG. 3 shows the X-ray diffraction data for an atomized powder of the present invention.

FIG. 3 shows the typical x-ray diffraction pattern produced by the alloys of the present invention. A relatively narrow scan ($\Delta 2\theta=20°$) is shown for clarity, however, even in $2\theta=100°$ there is no evidence of secondary phases in the stainless steel alloys of the present invention either before or after HIP consolidation.

Figure 4:
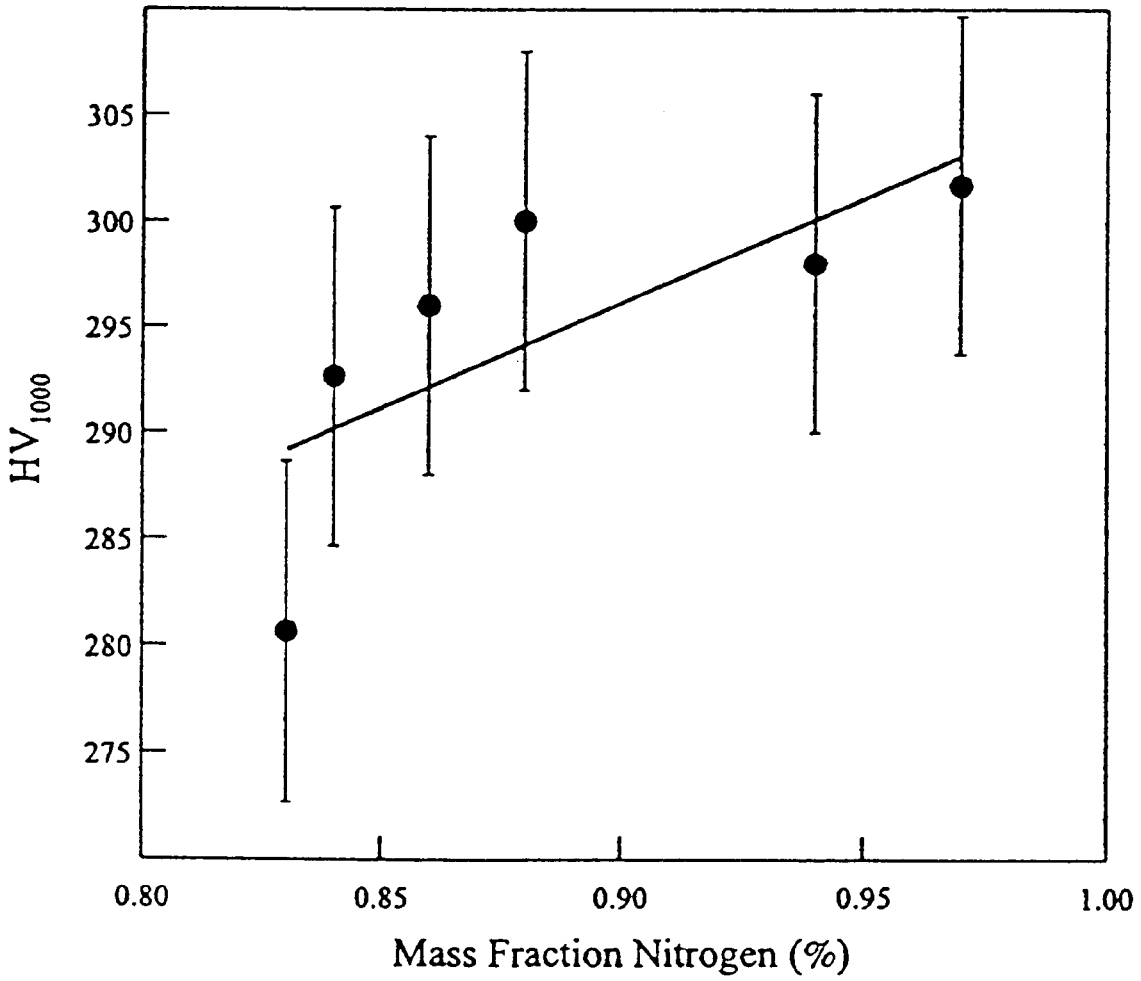
FIG. 4 shows a plot of hardness vs. nitrogen content of the alloys of the present invention.
Figure 5:
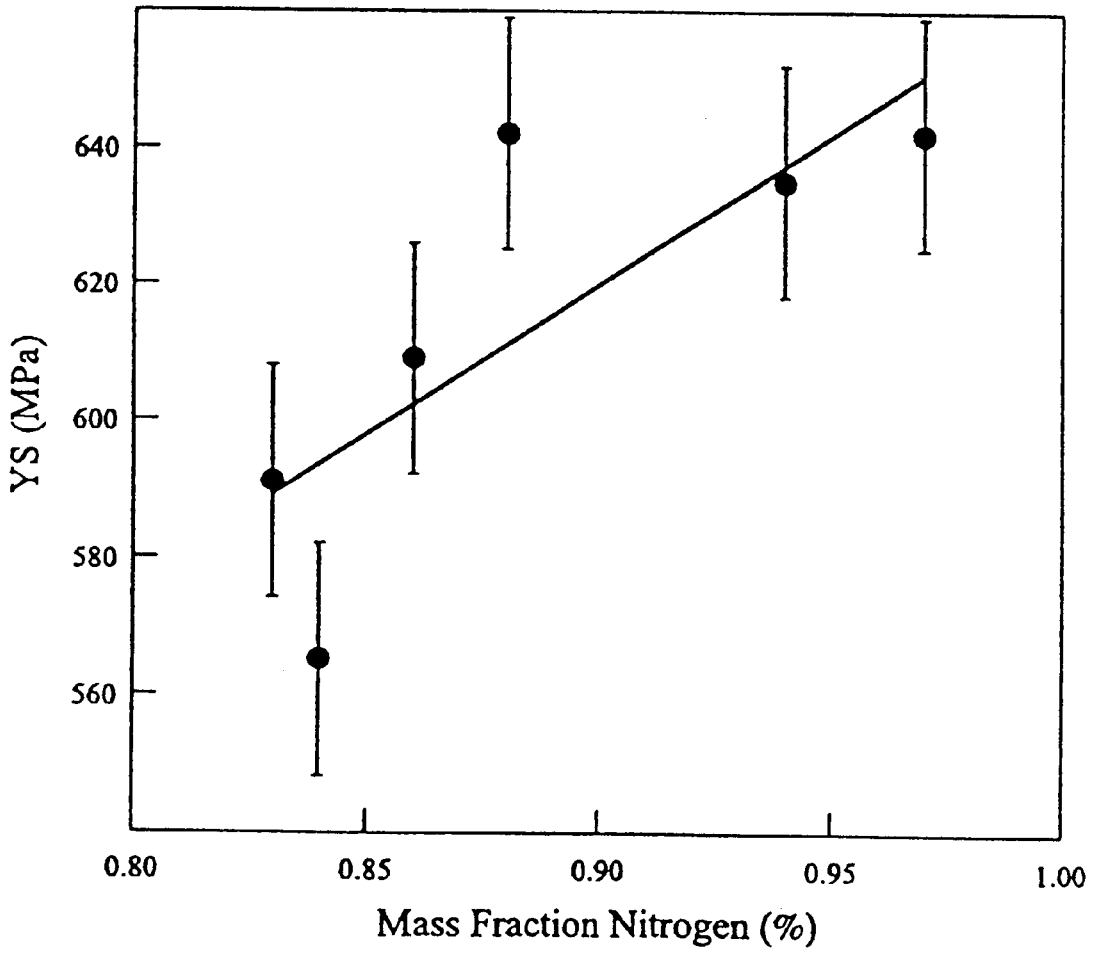
FIG. 5 shows a plot of yield strength vs. nitrogen content of the alloys of the present invention.

As can be seen in Table 2, in general, as the nitrogen content is increased, the chemical properties are improved. As the nitrogen mass fraction varies between 0.83 to 0.97, the Vickers hardness varies from 280 $HV_{1000}$ to 303 $HV_{1000}$, yield strength varies from 565 MPA to 642 MPA, and the UTS varies from 1034 to 1100 MPA. The microhardness and the yield strength are plotted against the nitrogen content in FIGS. 4 and 5 respectively. As can be seen in these figures, as the nitrogen content increases, so does the hardness and yield strength of the resulting alloy.

The increased hardness of the alloys of the examples and the high n values are expected to result in an improvement in wear resistance. After a preliminary evaluation using dry pin-on-disk testing, the coefficient of friction for these alloys falls in the range of $\mu$=0.5 to 0.6, which is similar to commercial steels.

In addition, the relatively high impact strength of the alloys in a further indication that there is a less likelihood that the alloys have secondary phases. As is known in the art, secondary phases, such as ferrite, stable nitrides and sigma (σ) phases reduce the impact strength of alloys as compared to alloys without these secondary phases.

Figure 6:
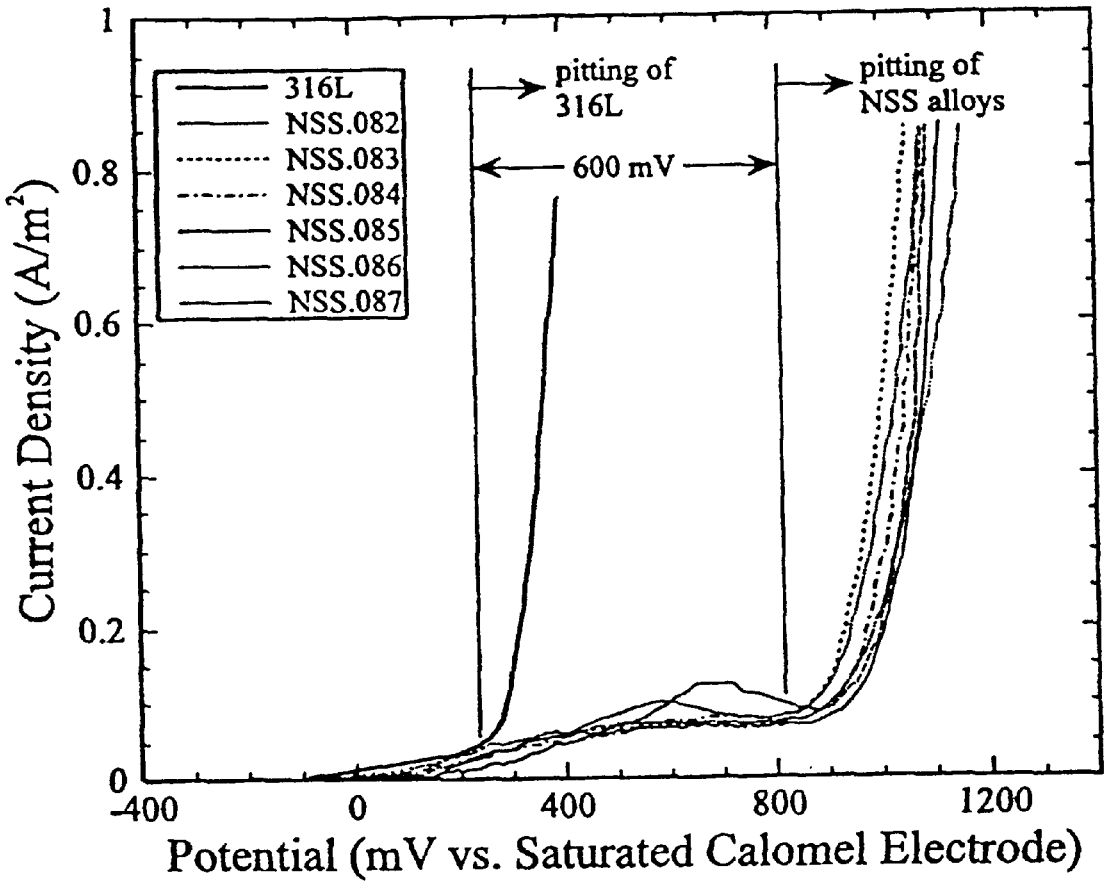
FIG. 6 shows polarization current vs. the potential for the alloys prepared in the Examples.

Each of the stainless steel alloys prepared in accordance with the foregoing examples was tested for corrosion resistance against an orthopedic implant grade 316L stainless steel. FIG. 6 shows the relative resistance of these alloys to corrosion and were evaluated by conducting an electrochemical polarization experiment. In these experiments, the relative corrosivity of the environment required to cause pitting of the different alloys was quantitatively assessed by increasing the potential of the sample with respect to the reference reaction in a slow and continuous manner until pitting occurred. With this technique, the onset of pitting can be detected and a relatively large increase is incurred and can be then verified with optical microscopy. FIG. 6 is plot of the polarization currents as a function of the potential with respect to an electrochemical reference reaction in a solution, used to evaluate corrosion resistance of alloys for orthopedic implants. As can be seen from FIG. 6, the pitting of the alloys of the present invention do not occur until the potential was 600 mV higher than required to cause pitting of the orthopedic implant grade stainless steel 316L. This means that the alloys of the present invention are significantly more resistant to pitting than 316L and that a significantly higher oxidation potential will be required to cause pitting of the alloys of the present invention as compared to 316L.

The high nitrogen stainless steel alloy of the present invention can be used to prepare articles of manufacture which will have superior mechanical and corrosion properties than any product available. The alloy of the present invention is useful in the following industries: pulp and paper, petrochemical, oil field, aerospace, pharmaceutical, cryogenics, electric power, medical, armed forces (armor for e.g., tanks, armored personal carriers, amphibious vehicles, body armor), railroad, automotive, nuclear and superconductivity, thermal spray and others.

We claim:

1. A high nitrogen stainless steel alloy which is substantially free of stable nitride and sigma phases, prepared by nitrogen gas atomization and consolidation, without solution treating and quenching said stainless steel.

2. The stainless steel alloy of claim 1, comprising about 27 to about 30% by weight Cr, about 1.5% to 4.0 by weight Mo, Mn is present and is present in an amount up to about 15% by weight, at least about 8% by weight Ni, about 0.8% to about 0.97 % by weight N and the balance being Fe.

3. The stainless steel alloy of claim 2, comprising 27.4% to 29.9% by weight Cr, 1.9% to 2.0% by weight Mo, 6.0% to 15% by weight Mn, 12% to 16% by weight Ni, 0.8 to 0.95% by weight N and 39% to 47% by weight Fe.

4. The stainless steel alloy of claim 2, wherein the Mn is present in an amount less than 10% by weight.

5. The stainless steel alloy of claim 2, wherein the Mn is present in an amount between 6 and 15% by weight.

6. The stainless steel alloy of claim 2, wherein the Cr is present in an amount between 27.4% and 29.9% by weight.

7. The stainless steel alloy of claim 2, wherein Ni is present in an amount between 10 and 16% by weight.

8. The stainless steel alloy of claim 7, wherein the Ni is present in an amount between 12 and 16% by weight.

9. The stainless steel alloy of claim 2, wherein Mo is present in an amount between 1.7 and 2.3% by weight.

10. The stainless steel alloy of claim 9, wherein the Mo is present in an amount at or about 2% weight.

11. The stainless steel alloy of claim 2, further comprising up to 3% by weight W.

12. A process for preparing the stainless steel alloy of claim 1, comprising melting a mixture of metals under a nitrogen atmosphere, atomizing the melted mixture of metals with nitrogen gas to form an alloy powder containing nitrogen, and consolidating the alloy powder.

13. The process of claim 12, wherein the consolidating is performed using a hot isostatic press.

14. A process for preparing the stainless steel alloy of claim 2, which is substantially free of stable nitrides and sigma (σ) phases, without solution treating and quenching steps to remove stable nitrides and sigma (σ) phases, said process comprising melting a mixture of metals, atomizing the melted mixture of metals with nitrogen gas to form an alloy powder containing nitrogen, and consolidating the alloy powder, thereby forming the stainless steel composition of claim 2.

15. An article comprising the stainless steel alloy of claim 1.

16. The article according to claim 15, which is a biomedical device.

17. The article according to claim 16, which is an orthopedic implant.

18. The article according to claim 15, which is armor.

19. A stainless steel alloy powder for preparing a stainless steel alloy which is substantially free of stable nitrides and sigma (σ) phases without solution treating and quenching steps to remove stable nitrides and sigma (σ) phases, comprising about 27 to about 30% by weight Cr, about 1.5 to about 4.0% by weight Mo, Mn is present and is in an amount up to about 15% by weight, at least about 8% by weight Ni, and about 0.8 to about 0.97% by weight N, with the balance being Fe.

20. The stainless steel alloy powder of claim 19, comprising 27.4% to 29.9% by weight Cr, at or about 2.0% by weight Mo, 6.0% to 15% by weight Mn, 12% to 16% by weight Ni, 0.8 to 0.95% by weight N and 39% to 47% by weight Fe.

21. An article comprising the stainless steel alloy of claim 2.

22. The article according to claim 21, which is a biomedical device.

23. The article according to claim 22, which is an orthopedic implant.

24. The article according to claim 21, which is armor.

* * * * *